US005999164A

United States Patent [19]

Ito

[11] Patent Number: 5,999,164

[45] Date of Patent: Dec. 7, 1999

[54] IMAGE DATA CONVERTER

[75] Inventor: Shuhei Ito, Hamamatsu, Japan

[73] Assignee: Yamaha Corporation, Hamamatsu, Japan

[21] Appl. No.: 08/799,124

[22] Filed: Feb. 16, 1997

[30] Foreign Application Priority Data

Feb. 16, 1996 [JP] Japan ..... 8-029576

[51] Int. Cl.[6] ..... G09Q 5/06

[52] U.S. Cl. ..... 345/154; 348/661; 345/199

[58] Field of Search ..... 345/154, 153, 345/431, 186, 199, 510; 348/659, 661, 660; 358/517, 518

[56] References Cited

U.S. PATENT DOCUMENTS 4,507,676 3/1985 Dischert et al. ..... 348/660
4,743,960 5/1988 Duvic et al. ..... 348/660
4,843,379 6/1989 Stansfield ..... 345/154
5,124,688 6/1992 Rumball ..... 345/154
5,220,412 6/1993 Oka ..... 348/659
5,373,327 12/1994 McGee et al. ..... 348/645
5,572,236 11/1996 Feig et al. ..... 345/154
5,784,050 7/1998 Corry ..... 345/154

*Primary Examiner*—Lun-Yi Lao
*Attorney, Agent, or Firm*—Pillsbury Madison & Sutro LLP

[57] ABSTRACT

Conversion of YUV-format data into RGB-format data is consecutively carried out through pipeline processing in two stages, namely, primary and secondary conversion which are derived from only the common expressions of theoretical conversion equations. The secondary conversion is executed by a circuit subsequent to ROMs 51*a* to 51*c*. Of the secondary conversion operation, the conversion of a G component requires complicated calculation. Therefore, analogous calculation is carried out to convert the G component.

13 Claims, 3 Drawing Sheets

IMAGE DATA CONVERTER

BACKGROUND OF THE INVENTION

1. Field of the Invention

The present invention relates to an image data converter which converts YUV-format image data into RGB-format image data.

2. Related Art

Conventionally, in a case where an image is displayed on a CRT (Cathode Ray Tube), YUV-format image data (hereinafter referred to as YUV data) is converted into RGB-format image data (hereinafter referred to as RGB data). The YUV data is image data which represents an image as a luminous component (Y) and color difference components (U, V). The RGB data is image data which represents an image as red (R), green (G), and blue (B) components.

In general, a man's visual sense has sufficiently lower resolution characteristics with respect to the color difference components than with respect to the luminous component. By utilization of this fact, natural images are chiefly represented as the YUV data, whereby the amount of data is compressed by reducing the resolution of color difference signals to half the resolution of the luminance signal. In this way, the YUV data is compressed. The YUV data has several formats according to a compression rate of the color difference components. For example, according to YUV 422 (wherein four dots of the Y data correspond to two dots of the U and V data), color difference data regarding horizontally adjacent two dots is handled as the same data. Further, according to YUV411 (in which four dots of the Y data correspond to one dot of the U and V data), color difference data regarding a square area of two dots in a horizontal direction by two dots in a vertical direction is handled as the same data.

As described above, there are various types of YUV data. However, regardless of the form of the YUV data, there is a common algorithm for converting YUV data into RGB data. An equation for logically converting the YUV data to the RGB data is given by the following expressions (1) to (3).

$$R=\{(256/219)\times(Y-16)\}+[\{256/(224\times0.713)\}\times(V-128)] \quad (1)$$

$$G=\{(256/219)\times(Y-16)\}+[\{(256\times0.114)/(224\times0.564\times0.587)\}\times(128-U)]+[\{(256\times0.299)/(224\times0.713\times0.587)\}\times(128-V)] \quad (2)$$

$$B=\{(256/219)\times(Y-16)\}\times[\{256/(224\times0.564)\}\times(U-128)] \quad (3)$$

In general, when image data is transmitted to a CRT, the image data is converted by the above-described conversion expressions (1) to (3). The previously-described conversion of image data requires one of the following methods. One method is to convert the image data to be transmitted to the CRT from a YUV format to an RGB format using software or a general-purpose DSP (digital signal processor) before the image data is stored in video memory. Resultant RGB data is stored in the video memory. The thus-stored RGB data is sequentially transmitted to the CRT from the video memory in accordance with a display scanning operation.

However, according to this method, it is necessary for a MPU (microprocessor unit) or the like to convert the image data from the YUV format to the RGB format, thereby burdening the MPU. The YUV data comprises compressed UV components, and hence the RGB data has a larger amount of data than that of the YUV data. For this reason, a large amount of capacity of the video memory is needed accordingly.

Another method is to sequentially transmit the YUV data read from the video memory to the CRT after having converted it to RGB data using an arithmetic circuit such as a general-purpose DSP provided in a stage subsequent to the video memory.

However, according to this method, the conversion of YUV data to RGB data requires complicated calculation. Therefore, the scale of the arithmetic circuit provided so as to be subsequent to the video memory becomes larger.

To simplify the arithmetic circuit, there has already been proposed a method of converting YUV data to RGB data by carrying out arithmetic operations using an analogous equation. According to this method, for example, conversion of an R component is approximated by the following expression (4).

$$\begin{aligned} R &= \{(256/219)\times(Y-16)\}+[\{256/(224\times0.713)\}\times(V-128)] \quad (4)\\ &= 1.169Y+1.603V-223.872\\ &\approx 1.125Y+1.625V-224\\ &= (1+1/8)\times Y+(1+1/2+1/8)\times Y+(1+1/2+1/8)\times V-224 \end{aligned}$$

By virtue of such approximation, the arithmetic circuit can be constructed by use of only simple shifters and full adders, which in turn enables a-reduction in circuit size.

Although the conventional approximation method allows a reduction in the circuit size in the manner as previously described, the converted R, G, and B components are different from their true values, thereby resulting in deterioration of picture quality of an output image.

SUMMARY OF THE INVENTION

The present invention has been conceived in the previously-described background. The object of the present invention is to provide an image data converter capable of converting YUV data into RGB data using a small-scale circuit without inducing any substantial deterioration of picture quality.

To solve the previously-described problem, the present invention relates to an image data converter for converting image data from a YUV format into a RGB format comprising:

- a storage means that handles common expressions which are included in theoretical conversion equations for R, G, B components and represent conversion of the image data from the YUV format to the RGB format, as a primary conversion equation, and that stores results of the conversion carried out according to the conversion equations, so as to correspond to values of Y, U, and V components respectively;
- a primary conversion means which read the results of the primary conversion corresponding to received Y, U, V components from the storage means and output the thus-read results as primary conversion data; and
- a secondary conversion means which calculates values of the R, G, and B components on the basis of the primary conversion data.

An embodiment of the present invention is provided by the fact that theoretical equations for converting the image data from the YUV format to the RGB format given by the following equations (a) to (c) are divided into a primary conversion equation given by equations (d) to (f) and a secondary conversion equation given by equations (g) to (i), whereby the image data is converted from the YUV format into the RGB format.

$$R=\{(256/219)\times(Y-16)\}+\{256/(224\times0.713)\}\times(V-128) \quad (a)$$

$$G=\{(256/219)\times(Y-16)\}+[\{(256\times0.114)/(224\times0.564\times0.587)\}\times(128-U)+[\{(256\times0.299)/(224\times0.713\times0.587)\}\times(128-V)] \quad (b)$$

$$B=\{(256/219)\times(Y-16)\}\times[\{256/(224\times0.564)\}\times(U-128)] \quad (c)$$

$$YY=\text{INT}\ \{(256/219)\times(Y-16)\} \quad (d)$$

$$UU=\text{INT}\ [\{256/(224\times0.564)\}\times(U-128)] \quad (e)$$

$$VV=\text{INT}\ [\{256/(224\times0.713)\}\times(V-128)] \quad (f)$$

(where INT bracketed by [] designates a function to transform a value bracketed by [] to an integer)

$$R=YY+VV \quad (g)$$

$$G=YY-(0.114/0.587)\times UU-(0.299/0.587)\times VV \quad (h)$$

$$B=YY+UU \quad (i)$$

The embodiment of the present invention is further provided by the fact that the secondary conversion means replaces the equation (h) with a predetermined analogous equation having $1/2^n$ as a coefficient in order to carry out multiplication with bit shift, whereby the value of a G component is calculated.

The embodiment of the present invention is provided by the fact that the predetermined analogous equation is defined as $$\begin{aligned} G &= YY-0.194\times UU-0.509\times VV \quad (j)\\ &\approx YY-0.1875\times UU-0.500\times VV\\ &= YY-[\{(1/8)\times UU\}+\{(1/16)\times UU\}]-(1/2)\times VV. \end{aligned}$$

The embodiment of the present invention is further provided by the fact that the primary conversion and the secondary conversion are continuously processed through pipeline processing.

DETAILED DESCRIPTION OF THE PREFERRED EMBODIMENTS

With reference to the accompanying drawings, one embodiment of the present invention will be described hereinbelow. The following embodiment is explained using, as an example, a case where YUV422 data is converted into RGB data.

(1) Overall Configuration

Figure 1:
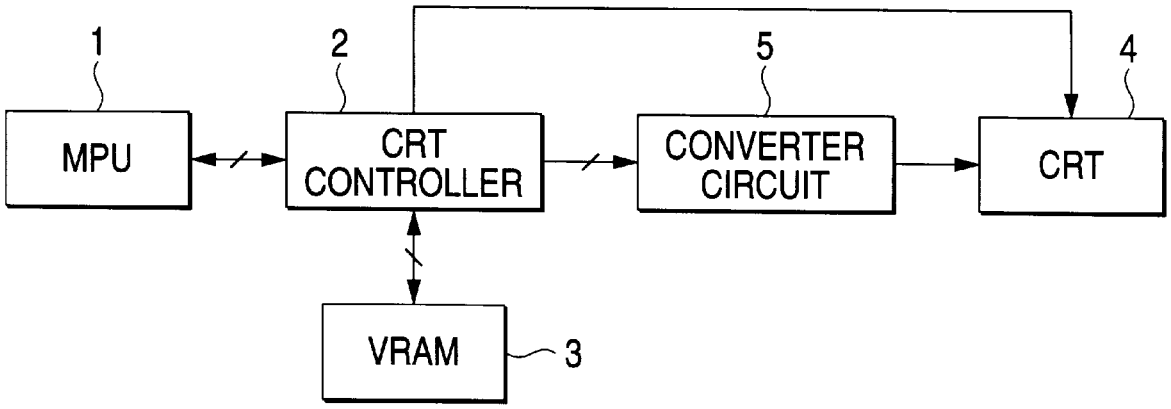
FIG. 1 is a block diagram showing the overall configuration of an image data converter according to one embodiment of the present invention.

FIG. 1 is a block diagram showing the overall configuration of an image data converter according to one embodiment of the present invention. In the drawing, reference numeral 1 designates a MPU (Microprocessor Unit) which outputs YUV data generated through predetermined arithmetic processing to a CRT controller 2. The CRT controller 2 temporarily stores the YUV data received from the MPU 1 in VRAM (Video RAM) 3. When an image is displayed, the CRT controller 2 outputs the YUV data read from the VRAM 3 to a converter circuit 5 while it is timed to a synchronizing signal (hereinafter referred to as a dot clock signal) to be supplied to a CRT 4.

The dot clock signal used herein is a periodic pulse signal whose one cycle is equal to the time required to one dot of transmit image data to the CRT 4. The converter circuit 5 converts the YUV data received from the CRT controller 2 to RGB data and outputs the thus-converted data to the CRT 4. The details of the converter 5 will be described later. The CRT 4 displays a color image corresponding to the RGB data received from the converter circuit 5 in synchronism with the dot clock signal received from the CRT controller 2.

Figure 2:
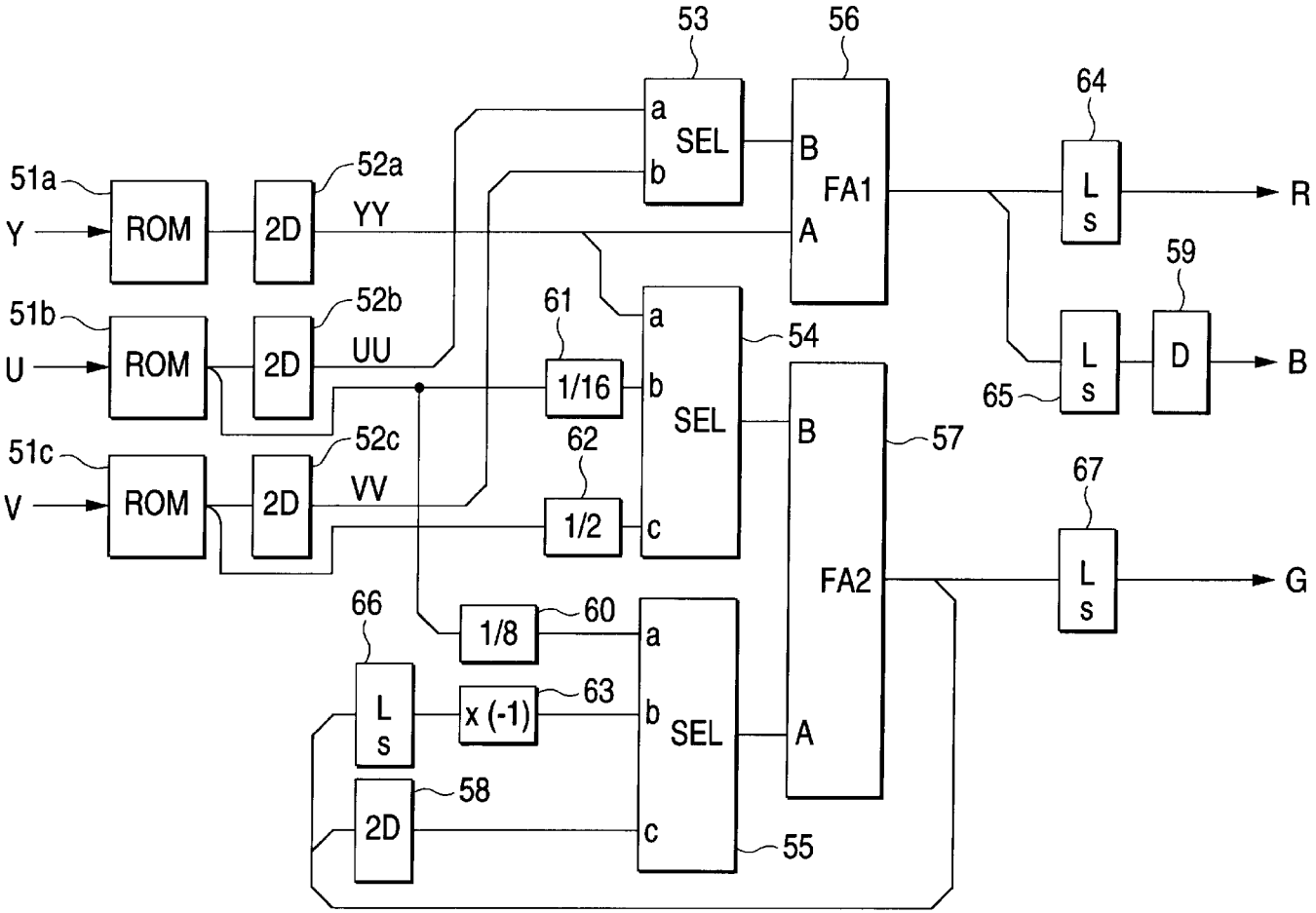
FIG. 2 is a block diagram showing the configuration of a conversion circuit of the embodiment.

(2) Configuration of the Converter Circuit 5:

With reference to a block diagram shown in FIG. 2, the configuration of the converter circuit 5 will be described. In FIG. 2, reference numerals 51*a* to 51*c* designate ROM (Read Only Memory). These ROM devices store conversion tables which hold primary conversion data YY, UU, and VV corresponding to the values of the Y, U, V components of the YUV data, respectively. The following primary conversion equations (5) to (7) give the primary conversion data YY, UU, and VV. In the equations, INT bracketed by {} or [] designates a function to transform a bracketed value to an integer.

$$YY=\text{INT}\{(256/219)\times(Y-16)\} \quad (5)$$

$$UU=\text{INT}[\{256/(224\times0.564)\}\times(U-128)] \quad (6)$$

$$VV=\text{INT}[\{256/(224\times0.713)\}\times(V-128)] \quad (7)$$

More specifically, the conversion of the image data from the YUV format to the RGB format carried out according to the previously-described equations (1) to (3) is separately executed in two stages; namely, a primary conversion stage carried out according to the aforementioned equations (5) to (7), and secondary conversion stage carried out according to the following equations (8) to (10).

$$R=YY+VV \quad (8)$$

$$G=YY-(0.114/0.587)\times UU-(0.299/0.587)\times VV \quad (9)$$

$$B=YY+UU \quad (10)$$

For primary conversion, post-conversion data is obtained by quoting the conversion tables stored in the ROM 51*a* to 51*c*. For secondary conversion, arithmetic operations are carried out by a circuit on a stage subsequent to the ROM 51*a* to 51*c* (hereinafter referred to as a secondary conversion circuit). These primary and secondary conversion operations are consecutively carried out through pipeline processing.

Of the above-described secondary conversion operations, conversion of the image data to a G component carried out according to the equation (9) requires complicated calculation. For this reason, approximations are made by use of an approximate equation having $1/2^n$ as coefficient in order to carry out multiplication with simple bit shift, as shown by the following equation (11), whereby the calculation is simplified.

$$\begin{aligned} G &= YY-0.194\times UU-0.509\times VV \quad (11)\\ &\approx YY-0.1875\times UU-0.500\times VV\\ &= YY-[\{(1/2^3)\times UU\}+\{(1/2^4)\times UU\}]-1/2\times VV \end{aligned}$$

The secondary conversion circuit is made up of delay circuits 52*a* to 52*c*, 58, 59, selectors 53 to 55, full adders 56 and 57, shifters 60 to 62, a sign change circuit 63, and latch circuits 64 to 67. The secondary circuit operates in synchronism with a reference clock signal whose frequency is twice the frequency of the previously-described dot clock signal.

The delay circuits 52*a* to 52*c* delay outputs from the ROM 51*a* to 51*c* by a period which is twice the period of the reference clock signal (i.e., by the period of the dot clock signal).

The selector 53 alternately selects an input signal from the signals received through input terminals "a" and "b" every period of the reference clock signal and outputs the thus-selected signal. The selector 54 selects an input signal from the signals received through the input terminals "all" to "c" every period of the reference clock signal in order such as a, c, b, c, a, c, b, c, . . . and outputs the thus-selected signal. The selector 55 selects an input signal from the signals received through input terminals "a" to "c" every period of the reference clock signal in order such as a, c, a, b, a, c, a, . . . and outputs the thus-selected signal.

The full adder 56 adds primary conversion data YY received from the ROM 51*a* through the delay circuit 52*a* to the output of the selector 53 received through an input terminal B (i.e., primary conversion data UU or VV), and outputs the result of such addition. The full adder 57 adds an output from the selector 54 received through the input terminal B to an output from the selector 55 received through an input terminal A, and outputs the result of such addition.

Next, the shifter 60 multiplies an output of the ROM 51*b* by ⅛ by carrying out shift operations and outputs the result of multiplication to the input terminal "a" of the selector 55. The shifter 61 multiplies an output value of the ROM 51*b* by 1/16 by carrying out shift operations and outputs the result of multiplication to the input terminal "b" of the selector 54. The shifter 62 multiplies an output of the ROM 51*c* by ½ by carrying out shift operations and outputs the result of multiplication to an input terminal "c" of the selector 54. The sign change circuit 63 multiplies a code bit of an output of the full adder 57 by −1 by inverting the code bit and outputs the result of multiplication to an input terminal "b" of the selector 55.

The latch circuits 64 and 65 latch an output of the full adder 56, and the latch circuits 66 and 67 latch an output of the full adder 57. The delay circuit 58 delays the output of the full adder 57 by the period of the dot clock signal, and the delay circuit 59 delays an output of the latch circuit 65 by the period of the reference clock signal.

(3) Operation of the Embodiment

Figure 3:
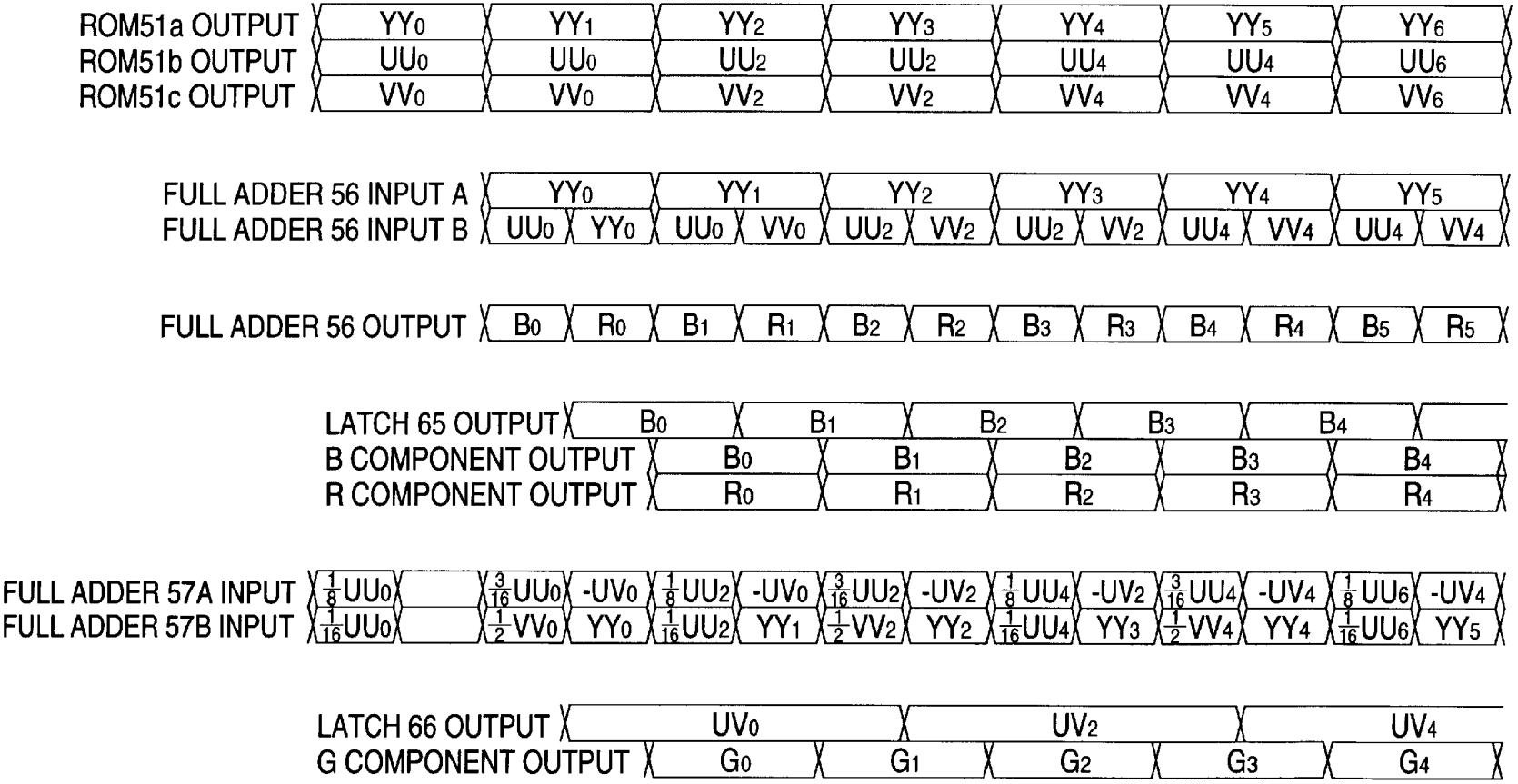
FIG. 3 is a timing chart for describing the operation of the conversion circuit.

With reference to a timing chart shown in FIG. 3, the operation of the image data converter of the present embodiment having the previously-described configuration will be described.

To begin with, the CRT controller 2 reads Y, U, and V components from the VRAM 3. When the thus-read components are input to the converter circuit 5, primary conversion data YYi, UUi, and VVi (i=0, 1, 2, . . . ) corresponding to the respective Y, U, and V components are read in parallel from the ROM 51*a* to 51*c* in the period of the dot clock signal.

Subsequently, the secondary conversion circuit calculates R and B components using the full adder 56. Specifically, the full adder 56 alternately carries out the calculation of the equations (8) and (10) in the period of the reference clock signal. B components, i.e., $B_0$, $B_1$, . . . are output during period T0, and R components, i.e., $R_0$, $R_1$, . . . are output during period T1.

These outputs of R and B components are subjected to timing adjustment by the latch circuits 64 and 65 and the delay circuit 59. Thereafter, the components are output to the CRT 4 in the period of the dot clock signal.

The full adder 57 calculates G components. In short, the full adder 57 calculates the following equation (12) during period T0 of the period which is four times the period of the reference clock signal and comprises periods T0 to T3.

$$(1/8)\times UU+(1/16)\times UU \tag{12}$$

Then, the full adder 57 also calculates the following equation (13) from period T0 to period T2 subsequent to the period of the dot clock signal.

$$\{(1/8)\times UU+(1/16)\times UU\}+(1/2)\times VV \tag{13}$$

Calculation result UVi of the equation (13) is latched in the latch circuit 66 in a period which is four times the period of the reference clock signal.

Further, the full adder 57 adds a value obtained by multiplying the calculation result UVi of the equation (13) by −1 to the primary conversion data YYi from period T2 to period T3 subsequent to the period of the reference clock signal, whereby the G component given by the following equation (14) is calculated.

$$(1/8)\times UU+(1/6)\times UU+(1/16)\times UU)\}+(1/2)\times VV] \tag{14}$$

Outputs $G_0$, $G_1$, . . . of the G component are subjected to adjustment with regard to timing by the latch circuit 67, and the thus-adjusted outputs are delivered to the CRT 4 in the period of the dot clock signal. As a result, the CRT 4 displays a color image corresponding to the R, G, and B components received from the converter circuit 5 in the period of the dot clock signal.

(4) Effect of the Embodiment

As have been described above, common portions of the theoretical conversion expressions (1) to (3) are extracted in the present embodiment, and the primary conversion expressions (5)–(7) are derived from the thus-extracted common portions. The calculation results of the primary conversion expressions (5) to (7) are previously retained in a table, whereby primary conversion is effected through table-based conversion. Subsequently, the R and B components are calculated by adding together the results of the primary conversion. The G component is analogously calculated by executing multiplication employs $1/2^{1n}$ as a coefficient. As a result of this, the YUV-format image data can be converted into RGB-format image data at-high speed, and the configuration of the conversion circuit 5 can be simplified. In contrast, only the G component is analogously calculated, which makes it possible to prevent the deterioration of picture quality due to conversion.

With reference to the results of the experiments presented in the following tables 1 and 2, the results of the conversion of the present embodiment and the results of conventional conversion based on CD-I standard are compared to each other. Table 1 provides post-conversion distortion factors (SNR) of sample images for each color as percentage (%). Table 2 provides the same results as decibel (dB).

TABLE 1

| | | Castle | Flower | Fruits | Girl | Cap | Woman | Portrait | Gray Still |
|---|---|---|---|---|---|---|---|---|---|
| Standard | Red | 0.028% | 0.044% | 0.035% | 0.036% | 0.028% | 0.022% | 0.037% | 0.057% |
| | Green | 0.022% | 0.047% | 0.050% | 0.055% | 0.031% | 0.043% | 0.035% | 0.057% |
| | Blue | 0.037% | 0.047% | 0.144% | 0.055% | 0.054% | 0.049% | 0.041% | 0.057% |
| | All | 0.017% | 0.027% | 0.031% | 0.028% | 0.020% | 0.020% | 0.022% | 0.033% |
| NVDP | Red | 0.012% | 0.023% | 0.021% | 0.014% | 0.010% | 0.010% | 0.025% | 0.012% |
| | Green | 0.008% | 0.020% | 0.022% | 0.012% | 0.009% | 0.013% | 0.021% | 0.012% |
| | Blue | 0.015% | 0.035% | 0.070% | 0.017% | 0.021% | 0.017% | 0.037% | 0.012% |
| | All | 0.007% | 0.015% | 0.018% | 0.008% | 0.007% | 0.007% | 0.016% | 0.007% |

TABLE 2

| | | Castle | Flower | Fruits | Girl | Cap | Woman | Portrait | Gray Still |
|---|---|---|---|---|---|---|---|---|---|
| Standard | Red | 71.1dB | 67.1dB | 69.2dB | 68.9dB | 71.2dB | 73.0dB | 68.7dB | 64.9dB |
| | Green | 73.0dB | 66.5dB | 66.1dB | 65.1dB | 70.3dB | 67.2dB | 69.1dB | 64.9dB |
| | Blue | 68.7dB | 66.6dB | 58.9dB | 65.1dB | 65.3dB | 66.2dB | 67.8dB | 64.9dB |
| | All | 75.3dB | 71.5dB | 70.1dB | 71.2dB | 73.9dB | 74.0dB | 73.3dB | 69.7dB |
| NVDP | Red | 78.1dB | 72.8dB | 73.8dB | 76.8dB | 79.7dB | 80.0dB | 72.1dB | 78.4dB |
| | Green | 81.5dB | 73.9dB | 73.3dB | 78.4dB | 80.9dB | 77.8dB | 73.7dB | 78.4dB |
| | Blue | 76.5dB | 69.2dB | 63.1dB | 75.3dB | 73.4dB | 75.6dB | 68.6dB | 78.4dB |
| | All | 83.0dB | 76.3dB | 75.1dB | 81.4dB | 82.8dB | 82.8dB | 75.9dB | 83.1dB |

As is evident from Tables 1 and 2, the distortion factors of all the sample images obtained in the present embodiment are lower than those obtained as a result of the conventional conversion. The analogously-calculated G component has no distinguished large distortion. Consequently, it is said that such a distortion of the G component does not result in any substantial deterioration of the picture quality.

(5) Modifications

Although the G component was analogously calculated by the analogous expression (11) in the above-described embodiment in order to speed up calculation as well as to reduce circuit size, another analogous expression may be adopted instead of such an analogous expression. Particularly, the G component is expressed by a coefficient such as ½, ⅛, 1/16, or the like, with the intention of calculation which requires simple bit operations. The G component will not be limited to such an expression unless the size of circuitry has limitations.

Although the above-described embodiment has been described with reference to the case where the most popular YUV422 data is converted into RGB data, an image data converter for use with YUV411 data can be substantially formed from the identical circuit, because such data also requires the identical conversion algorithm.

As has been described above, the present invention makes it possible to convert YUV-format data into RGB-format data at high speed with small-size circuitry without substantially deteriorating picture quality.

What is claimed is:

1. An image data converter for converting image data from a YUV format into an RGB format comprising:

storage means for handling common expressions included in theoretical conversion equations for converting image data from the YUV format to the RGB format, the common expressions being defined by primary conversion equations, and for storing results of conversions carried out according to the primary conversion equations, so as to hold the common expressions that correspond to values of Y, U, and V components, respectively;

primary conversion means for reading, from the common expressions corresponding to the values of Y, U, and V components in the storage means, the results of common expressions corresponding to received Y, U, V components and outputting the read results as primary conversion data; and secondary conversion means for calculating values of the R, G, and B components on the basis of the primary conversion data, wherein the R and B components are calculated by adding together different combinations of the results of the primary conversion, and the G component is approximately calculated by executing multiplication that employs $1/2^n$ as coefficients, where n is an integer.

2. The image data converter as defined in claim 1, wherein the primary conversion and the secondary conversion are continuously processed through pipeline processing.

3. The image data converter as defined in claim 1, wherein the primary conversion equations are defined as $$YY=\mathrm{INT}\ \{(256/219)\times(Y-16)\}$$

$$UU=\mathrm{INT}\ [\{256/(224\times 0.564)\}\times(U-128)]$$

$$VV=\mathrm{INT}\ [\{256/(224\times 0.713)\}\times(V-128)]$$

(where INT bracketed by [] designates a function to transform a value bracketed by [] to an integer).

4. The image data converter as defined in claim 1, wherein the storage means includes ROM (Read Only Memory) devices for storing the common expressions that correspond to values of Y, U, and V components, respectively, the common expressions resulting from the conversions carried out according to the primary conversion equations.

5. The image data converter as defined in claim 4, wherein the primary conversion means reads, from the common expressions corresponding to values of Y, U, and V components in the ROM devices, common expressions corresponding to received Y, U, V components, and outputs the read results as primary conversion data.

6. The image data converter as defined in claim 1, wherein the secondary conversion means for calculating the value of the R component includes a full adder for adding, from the storage means, the common expression corresponding to the received Y component through a delay circuit to the common expression corresponding to the received V component through a delay circuit and a selector.

7. The image data converter as defined in claim 1, wherein the secondary conversion means for calculating the value of the B component includes a full adder for adding, from the storage means, the common expression corresponding to the received Y component through a delay circuit to the common expression corresponding to the received U component through a delay circuit and a selector.

8. The image data converter as defined in claim 1, wherein the secondary conversion means for calculating a value of the G component includes a shifter for multiplying the common expression corresponding to the received U component by ⅛, a shifter for multiplying the common expression corresponding to the received U component by 1/16, a shifter for multiplying the common expression corresponding to the received V component by ½, a sign change circuit for multiplying a code bit of an output of a full adder by −1, and a selector for selecting different inputs to be outputted.

9. An image data converter for converting image data from a YUV format into a RGB format comprising:

storage means for handling common expressions included in theoretical conversion equations for converting image data from the YUV format to the RGB format, the common expressions being defined by primary conversion equations, and for storing results of conversions carried out according to the primary conversion equations, so as to hold the common expressions that correspond to values of Y, U, and V components, respectively;

primary conversion means for reading, from the common expressions corresponding to values of Y, U, and V components in the storage means, the results of common expressions corresponding to received Y, U, V components and outputting the read results as primary conversion data; and secondary conversion means for calculating values of the R, G, and B components on the basis of the primary conversion data of the common expressions corresponding to the received Y, U, and V components, wherein theoretical equations for converting the image data from the YUV format to the RGB format given by the following equations (a) to (c) are divided into primary conversion equations (d) to (f) and secondary conversion equations (g) to (i), whereby the image data is converted from the YUV format into the RGB format:

$$R=\{(256/219)\times(Y-16)\}+\{256/(224\times0.713)\}\times(V-128) \quad (a)$$

$$G=\{(256/219)\times(Y-16)\}+[\{256\times0.114)/(224\times0.564\times0.587)\}\times(128-U)]+\{256\times0.299)/(224\times0.713\times0.587)\}\times(128-V) \quad (b)$$

$$B=(256/219)\times(Y-16)+\{256/(224\times0.564)\}\times(U-128) \quad (c)$$

$$YY=\mathrm{INT}\ \{(256/219)\times(Y-16)\} \quad (d)$$

$$UU=\mathrm{INT}\ [\{256/(224\times0.564)\}\times(U-128)] \quad (e)$$

$$VV=\mathrm{INT}\ [\{256/(224\times0.713)\}\times(V-128)] \quad (f)$$

(where INT bracketed by [] designates a function to transform a value bracketed by [] to an integer)

$$R=YY+VV \quad (g)$$

$$G=YY-(0.114/0.587)\times UU-(0.299/0.587)\times VV \quad (h)$$

$$B=YY+UU \quad (i).$$

10. The image data converter as defined in claim 9, wherein the secondary conversion means replaces the equation (h) with a predetermined analogous equation having $1/2^n$ as a coefficient in order to carry out multiplication with bit shift, whereby the value of a G component is calculated.

11. The image data converter as defined in claim 10, wherein the predetermined analogous equation is defined as $$\begin{aligned} G &= YY-0.194\times UU-0.509\times VV \quad (j)\\ &\approx YY-0.1875\times UU-0.500\times VV\\ &= YY-\{(1/8)\times UU+(1/16)\times UU\}-(1/2)\times VV. \end{aligned}$$

12. The image data converter as defined in claim 9 wherein the primary conversion and the secondary conversion are continuously processed through pipeline processing.

13. A method for converting image data from a YUV format into an RGB format comprising:

handling common expressions included in theoretical conversion equations for converting image data from the YUV format to the RGB format, the common expressions being defined by primary conversion equations;

storing in a storage means results of conversions carried out according to the primary conversion equations, so as to hold the common expressions that correspond to values of Y, U, and V components, respectively;

reading, from the common expressions corresponding to the values of Y, U, and V components in the storage means, the results of common expressions corresponding to received Y, U, V components and outputting the read results as primary conversion data; and calculating values of the R, G, and B components on the basis of the primary conversion data, wherein the R and B components are calculated by adding together different combinations of the results of the primary conversion, and the G component is approximately calculated by executing multiplication that employs $1/2^n$ as coefficients, where n is an integer.

* * * * *